US005967754A

United States Patent [19]

Chou

[11] Patent Number: 5,967,754

[45] Date of Patent: Oct. 19, 1999

[54] ONE-PIECE CEILING FAN ARM AND BLADE UNIT

[75] Inventor: Wang Liang Chou, Taichung, Taiwan

[73] Assignee: Aloha Housewares Co., Ltd., Taiwan

[21] Appl. No.: 08/998,330

[22] Filed: Dec. 24, 1997

[51] Int. Cl.[6] ..... F01D 5/30; F01D 25/00; F04D 29/38; F03D 11/00

[52] U.S. Cl. ..... 416/210 R; 416/5; 416/210 R; 416/241 A

[58] Field of Search ..... 416/5, 210 R, 416/241 A

[56] References Cited

U.S. PATENT DOCUMENTS

| | | | |
|---|---|---|---|
| D. 357,978 | 5/1995 | Young . | |
| D. 377,392 | 1/1997 | Liu . | |
| D. 378,312 | 3/1997 | Davis, Jr. . | |
| 3,713,753 | 1/1973 | Brunsch . | |
| 4,671,739 | 6/1987 | Read et al. . | |
| 4,746,271 | 5/1988 | Wright | 416/132 A |
| 5,304,037 | 4/1994 | Scofield | 416/134 R |
| 5,403,160 | 4/1995 | You . | |
| 5,458,463 | 10/1995 | Chiang | 416/210 R |
| 5,458,464 | 10/1995 | Lee . | |
| 5,486,094 | 1/1996 | Davis, Jr. et al. | 416/210 R |

*Primary Examiner*—Edward K. Look
*Assistant Examiner*—Rhonda Barton
*Attorney, Agent, or Firm*—Haynes and Boone, L.L.P.

[57] ABSTRACT

A one-piece injection molded arm and blade unit for a ceiling fan, or the like, in which a blade forms an extension of an arm. At least one web formed on the arm, and at least one other web is formed on the arm and extends at an angle to the first web. The webs serve to add strength to the unit to counteract the various stresses placed on the unit during operation.

16 Claims, 2 Drawing Sheets

ONE-PIECE CEILING FAN ARM AND BLADE UNIT

BACKGROUND OF THE INVENTION

The present invention relates to ceiling fans, and, in particular, to a one-piece arm and blade unit for a ceiling fan.

Ceiling fans include a motor disposed in a housing and a plurality of arm and blade assemblies connected to the motor for rotation. Each arm and blade assembly is typically manufactured as two pieces which are then permanently joined. One reason for such a two-piece design is that the blades are typically made out of a lightweight material such as a lightweight wood or plastic, in order to reduce the overall weight of the fan, while the arms must be sufficiently rigid and strong to withstand the various stresses from the fan operation.

These stresses are numerous and severe and, as such, limit the design possibilities of the arm and blade assemblies. For example, a centrifugal stress acts on the arm and blade assembly which can cause radial separation of the blades from the motor portion due to the centrifugal weight of the blades which increases as the fan speed increases. Another stress is caused by the aerodynamics of the fan blades as they rotate through the air. More specifically, and assuming that the fan is rotating in a direction to blow air downwardly, the air stream passing over the blade surface creates a "lift stress" which can cause each blade to bend toward the ground as the fan is operated. Similarly, a reactive stress results from the fan blades thrusting air rearwardly behind them toward the ceiling. Also, streams of air from a vent, or the like, passing through or into a portion of the normal air path through the fan, increases lift and reactive stresses on the individual fan blades as they pass through the airstream pathway. Further, a twist stress, caused primarily by centrifugal forces, may cause each fan blade to tend to twist about its longitudinal axis; while harmonic, or noise, stress can set up standing vibrational or oscillatory waves in the fan. Therefore, if the arm and blade assemblies of the fan are not designed properly, the fan will vibrate, rock and shake during use.

Although it would be desirable, from at least a manufacturing efficiency standpoint, to manufacture a one-piece arm and blade unit, it is very difficult due to the facts that the arm and blade assemblies must be relatively light in weight and must withstand the above stresses. Therefore, arm and blade assemblies constructed of the lightweight materials mentioned above are not ordinarily strong and rigid enough to withstand the stresses. While new and stronger plastics or polyresins are being developed, one-piece plastic fan arm and blade assemblies fabricated from these plastics are relatively expensive and still often cannot withstand many of the stresses mentioned above.

Therefore, what is needed is a one-piece arm and blade unit for a ceiling fan that is rigid enough to withstand the above stresses yet is relatively light in weight and inexpensive to manufacture.

SUMMARY OF THE INVENTION

Accordingly, a one-piece injection molded arm and blade unit for a ceiling fan, or the like, is provided in which a blade forms an extension of an arm. At least one web formed on the arm, and at least one other web is formed on the arm and extends at an angle to the first web.

Several advantages result from the above. For example, the arm and the webs add strength to the unit to counteract the various types of stresses discussed above. Also, the unit can be easily and inexpensively manufactured of a relatively lightweight plastic, one-piece material. Other features and advantages will become apparent from the following detailed description of the invention.

DESCRIPTION OF THE PREFERRED EMBODIMENT

Figure 1:
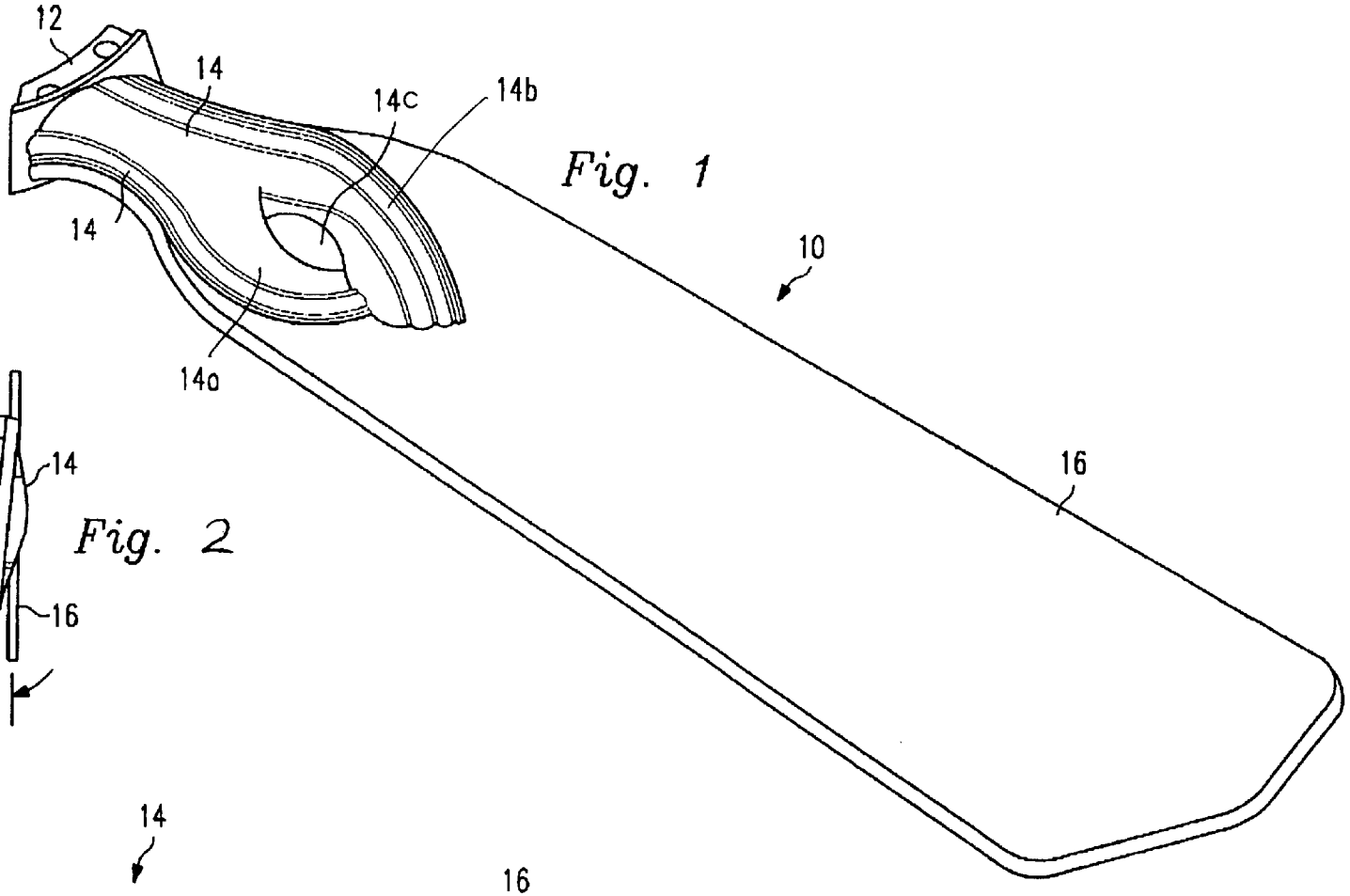
FIG. 1 is an isometric view of the upper portion of an embodiment of the one-piece ceiling fan arm and blade unit of the present invention.

Referring to FIG. 1 of the drawings, the reference numeral 10 refers, in general, to the one-piece ceiling fan arm and blade unit of the present invention. The unit 10 includes a bracket 12 for attaching the unit 10 to the motor (not shown) of a ceiling fan. An arm 14 extends from the bracket 12, and has two curved branches 14*a* and 14*b* which together define an opening 14*c*.

A blade 16 is formed integrally with the arm 14 and extends outwardly from the arm. The bracket 12, the arm 14 and the blade 16 are fabricated from a plastic material such as polyresin, and are formed integrally into one piece by an injection mold process. The preferred type of polyresin material used is a rigid polyresin that can withstand the various stresses mentioned above, but which also exhibits resilient characteristics. Since this type of material is well known in the art, it will not be described in detail.

The arm 14 and its branches 14*a* and 14*b* are raised relative to the upper surface of the blade 16, as viewed in FIG. 1, to add strength to the arm, and parallel ridges are formed in the arm and the branches to assist the air flow along the arm during use.

Figure 2:
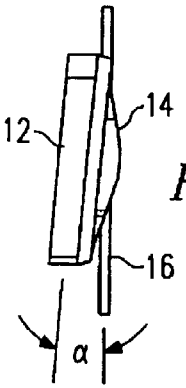
FIG. 2 is an end view of the unit of FIG. 1.
Figure 3:
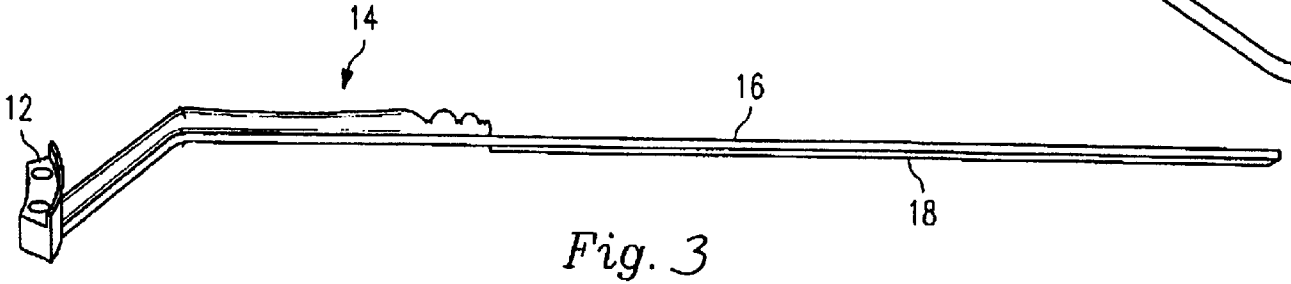
FIG. 3 is a side elevation view of the unit of FIG. 1.

As shown in FIG. 2, the arm 14 is twisted relative to the blade 16, so that the bracket 12 extends at an angle $\alpha$ relative to the blade 16. The angle $\alpha$ may typically range from 9 degrees to 15 degrees, and the preferred range is 13 to 14 degrees. The arm 14 is also bent as shown in FIG. 3, so that the bracket 12 extends in a different plane than the blade 16. This twisting and bending of the arm 14 is for the purpose of enabling the blade 16 to assume a proper orientation when the bracket 12 is connected to a fan motor.

Figure 4:
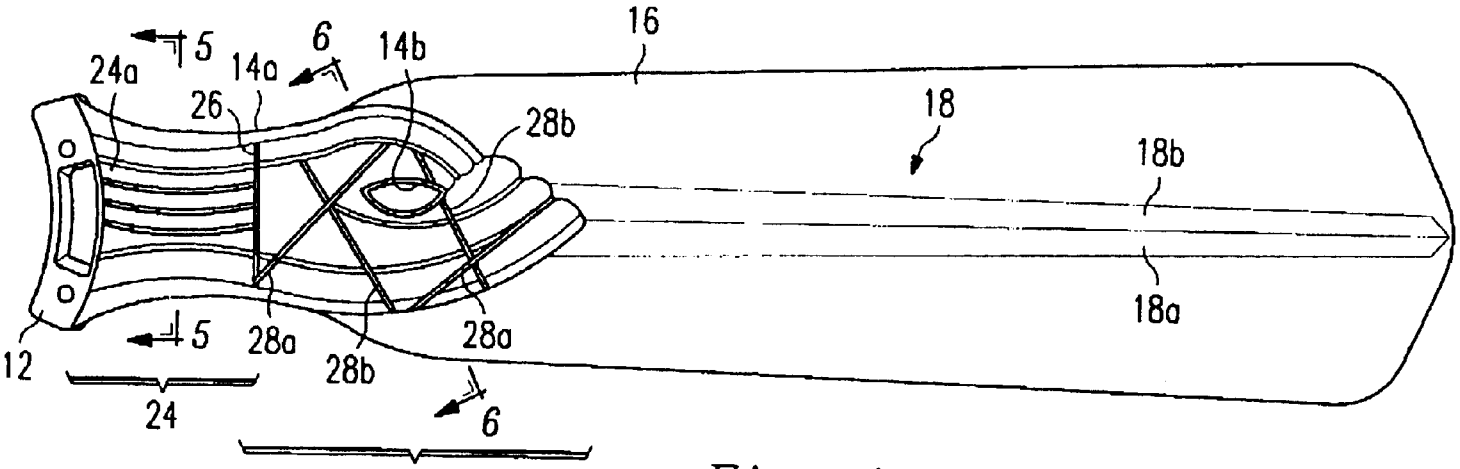
FIG. 4 is a bottom view of the unit of FIG. 1.
Figure 6:
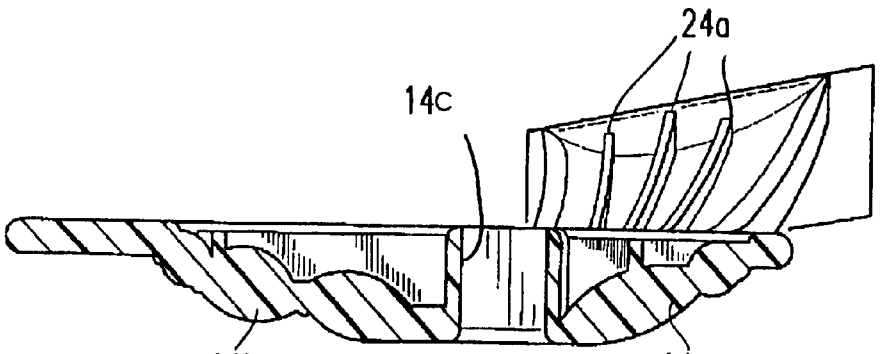
FIGS. 5 and 6 are sectional views taken along the lines 5—5 and 6—6, respectively, of FIG. 4.
Figure 5:
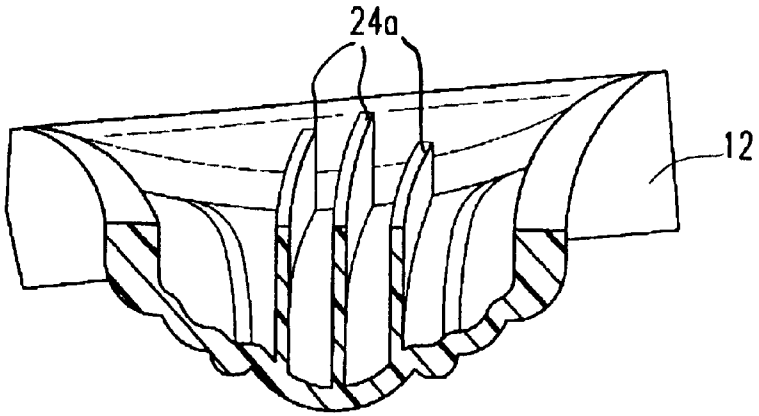

As shown in FIG. 4, a longitudinally-extending web 18 is formed on the opposite, or lower, surface of the blade 16 and includes two raised angled portions 18*a* and 18*b*. The web 18 facilitates airflow while adding longitudinal strength and rigidity to the blade 16. A web area 24 is formed on the lower portion of the arm 14 near the end thereof that is connected to the bracket 12. As shown in FIGS. 4–6, three individual webs 24*a* are formed in the web area 24 and extend in a generally parallel spaced relationship and in an axial direction. The webs 24*a* intersect a bulk head web 26 (FIG. 4) which extends transversely across the arm 14 and perpendicular to the webs 24*a*.

A web area 28 is also provided on the lower portion of the arm 14 and extends from the bulk head web 26 towards the other end of the arm 14. Two generally parallel webs 28*a* are formed in the web area 28 which extend approximately 45 degrees relative to the axis of the blade 16, and two parallel webs 28*b* extend approximately perpendicular to the webs 28*a*.

There are several advantages associated with the arm and blade unit 10. For example, raised arm 14, the webs 24*a,* the bulkhead web 26 and the webs 28*a* and 28*b* add strength to the unit 10 and, more specifically, counteract the various types of stresses discussed above. Also, the unit 10 can be manufactured of a relatively lightweight plastic, one-piece material. Further, the arm 14 and the web portions 18*a* and 18*b* are aerodynamically formed to facilitate air flow while adding longitudinal strength and rigidity to the blade 16. As a result, bending or drooping along the blade 16 after substantial use caused by the various above-mentioned stresses is prevented. Further, the opening 14*c* formed by arm branches 14*a* and 14*b* in the arm 14 reduces air resistance and air noise created by the blade 16 as it rotates.

It is understood that variations may be made in the foregoing without departing from the scope of the invention. For example, the invention is not limited to a single bulkhead web 26 but can include a plurality of webs identical to the bulkhead web 26. Also, the webs 28*a* and 28*b* do not necessarily have to extend in a perpendicular relation but can extend in a range of 75 degrees to 105 degrees to each other.

Although an embodiment of the method and apparatus of the present invention has been illustrated in the accompanying drawings and described in the foregoing description, it will be understood that the invention is not limited to the embodiment disclosed, but is capable of numerous rearrangements, modifications and substitutions without departing from the spirit of the invention as set forth and defined by the following claims.

What is claimed is:

1. A one-piece injection molded arm and blade unit comprising an arm, a blade forming an extension of the arm, a plurality of parallel webs formed on the arm and extending axially relative to the blade, and at least one other web formed on the arm and extending at an angle to the first web.

2. The unit of claim 1 wherein the blade has an upper surface and a lower surface and wherein the arm is raised above the upper surface of the blade and wherein the webs are formed on the lower surface of the blade.

3. The unit of claim 1 further comprising a bulk-head web formed at the intersection of the one web and the other web.

4. The unit of claim 1 wherein there are a plurality of the other webs a first portion of which extend generally perpendicular to a second portion.

5. The unit of claim 1 further comprising a bracket connected to and end of the arm for connecting the blade to a fan motor.

6. The assembly of claim 5 wherein the arm is bent and twisted so that the blade can attain a predetermined orientation relative to the fan motor.

7. A one-piece injection molded arm and blade unit comprising an arm, a blade forming an extension of the arm, at least one first web formed on the arm, at least one second web formed on the arm and extending at an angle to the first web, and a third web extending longitudinally along the blade from at least one of the other webs to an end of the blade.

8. The unit of claim 7 wherein the third web comprises two raised angled portions.

9. The unit of claim 7 wherein the blade has an upper surface and a lower surface, wherein the arm is raised above the upper surface of the blade, and wherein the webs are formed on the lower surface of the blade.

10. The unit of claim 7 wherein the blade has an upper surface and a lower surface and wherein the arm is raised above the upper surface of the blade and wherein the webs are formed on the lower surface of the blade.

11. The unit of claim 7 further comprising a bulk-head web formed at the intersection of the one web and the other web.

12. The unit of claim 7 wherein there are a plurality of the first webs extending axially relative to the blade and parallel to each other.

13. The unit of claim 7 wherein there are a plurality of the second webs, a portion of the second webs extending generally perpendicular to another portion of the second webs.

14. The unit of claim 7 wherein the third web comprises two raised angled portions.

15. The unit of claim 7 further comprising a bracket connected to an end of the arm for connecting the blade to a fan motor.

16. The assembly of claim 15 wherein the arm is bent and twisted so that the blade can attain a predetermined orientation relative to the fan motor.

* * * * *